United States Patent [19]

Okada et al.

[11] Patent Number: 4,729,348

[45] Date of Patent: Mar. 8, 1988

[54] CYLINDER HEAD STRUCTURE FOR V-TYPE ENGINE

[75] Inventors: Masatoshi Okada, Kariya; Koji Asanomi, Hiroshima; Masahiro Choshi, Hiroshima; Ryoji Abe, Hiroshima, all of Japan

[73] Assignee: Mazda Motor Corporation, Japan

[21] Appl. No.: 40,908

[22] Filed: Apr. 21, 1987

[30] Foreign Application Priority Data

Apr. 23, 1986 [JP] Japan ..... 51-93941

[51] Int. Cl.[4] ..... F01L 1/12

[52] U.S. Cl. ..... 123/90.31; 123/90.27; 123/195 C; 123/55 VS; 123/90.38

[58] Field of Search ..... 123/90.31, 90.27, 195 C, 123/195 S, 193 H, 55 VF, 55 VS, 55 VE, 55 V, 90.38

[56] References Cited

U.S. PATENT DOCUMENTS

| | | | |
|---|---|---|---|
| 1,406,271 | 2/1922 | Michelsen | 123/90.31 |
| 3,482,553 | 12/1969 | Buchwald | 123/90.31 |
| 3,673,990 | 7/1972 | Alfieri | 123/90.31 |
| 4,230,074 | 10/1980 | Ichikawa et al. | 123/90.31 |
| 4,480,603 | 11/1984 | Tsuboi | 123/90.31 |
| 4,480,609 | 11/1984 | Hayashi | 123/195 C |
| 4,494,494 | 1/1985 | Yahiro et al. | 123/55 VS |
| 4,516,546 | 5/1985 | Choushi et al. | 123/195 C |
| 4,610,224 | 9/1986 | Fujita | 123/90.31 |
| 4,643,143 | 2/1987 | Uchiyama et al. | 123/90.31 |
| 4,648,359 | 3/1987 | Ito | 123/90.31 |
| 4,658,769 | 4/1987 | Horis et al. | 123/90.31 |

FOREIGN PATENT DOCUMENTS

| | | | |
|---|---|---|---|
| 202315 | 11/1983 | Japan | 123/90.31 |
| 70820 | 4/1984 | Japan | 123/90.31 |
| 103163 | 1/1917 | United Kingdom | 123/90.31 |
| 557700 | 12/1943 | United Kingdom . | |
| 603052 | 6/1948 | United Kingdom . | |
| 604332 | 7/1948 | United Kingdom . | |

OTHER PUBLICATIONS

Japanese Unexamined Patent Publication No. 58 (Jul. 1983)-119929.

Japanese Unexamined Utility Model Publication No. 60 (Dec. 1985)-183250.

*Primary Examiner*—Ira S. Lazarus

*Attorney, Agent, or Firm*—Gerald J. Ferguson, Jr.; Michael P. Hoffman; Michael J. Foycik, Jr.

[57] ABSTRACT

A cylinder head structure for a V-type engine comprising a pair of cylinder head members which are the same in shape and oriented in opposite directions and which are provided in each of the front and rear end wall portions with an opening. Camshafts are supported for rotation in the respective cylinder head members so that their respective one ends project outside through the openings on the same end of the engine. A cam pulley is mounted on the projecting portion of each cam shaft, and a transmission belt is provided for transmitting the driving force of the crankshaft to the cam pulley on each camshaft. A pair of first cover members are mounted on the end wall portions of the respective cylinder head members through which the camshafts project to form closed cross section spaces together with the corresponding cylinder head members for covering the transmission belt. Second cover members are mounted on the end wall portions of the respective cylinder heads opposite to the end wall portions through which the camshafts project to cover the openings therein.

10 Claims, 3 Drawing Figures

CYLINDER HEAD STRUCTURE FOR V-TYPE ENGINE

BACKGROUND OF THE INVENTION

1. Field of the Invention

This invention relates to a cylinder head structure for a V-type engine.

2. Description of the Prior Art

In Japanese unexamined patent publication No. 58(1983)-119929, there is disclosed a cylinder head for a V-type engine in which camshafts are rotatably supported in the respective cylinder heads of the left and right cylinder banks to project forward from the front ends of the cylinder heads, cam pulleys are mounted on the projected portions of the camshafts, a chain belt is passed around the cam pulleys and a crank pulley to drivingly connected the crank pulley and the cam pulleys and a chain casing for covering the chain belt is formed integrally with the cylinder heads.

In such a V-type engine, the manhour required for part control can be reduced by using identical cylinder heads for the left and right cylinder heads since the left and right cylinder heads are the same in shape.

However, since the left and right cylinder heads are symmetrical with respect to the center of the cylinder banks and accordingly the cylinder heads for the respective cylinder banks are reversed in back-front orientation, when the chain casing is formed integrally with the cylinder head, the chain casings are positioned on the front side in one of the cylinder banks and on the rear side in the other cylinder bank, thereby making it difficult to layout of the cam pulley driving system.

Further, the width of the cylinder head depends on the width of the chain casing which is generally wider than the cylinder head body, thereby adding to the overall size of the engine.

SUMMARY OF THE INVENTION

In view of the foregoing observations and description, the primary object of the present invention is to provide a cylinder head structure for a V-type engine which enables the use of identical cylinder heads for the left and right cylinder banks.

In accordance with the present invention, there is provided a cylinder head structure for a V-type engine comprising a pair of cylinder head members which are the same in shape and oriented in opposite directions and which are provided in each of the front and rear end wall portions with an opening, camshafts supported for rotation in the respective cylinder head members so that the respective one ends of the camshafts project outside through the openings on the same end of the engine, a cam pulley mounted on the projecting portion of each cam shaft, a transmission belt means for transmitting the driving force of the crankshaft to the cam pulley on each camshaft, a pair of first cover members mounted on the end wall portions of the respective cylinder head members through which the camshafts project to form closed cross section spaces together with the corresponding cylinder head members for covering the transmission belt means, and second cover members mounted on the end wall portions of the respective cylinder heads opposite to the end wall portions through which the camshafts project to cover the openings therein.

DESCRIPTION OF THE PREFERRED EMBODIMENTS

Figure 1:
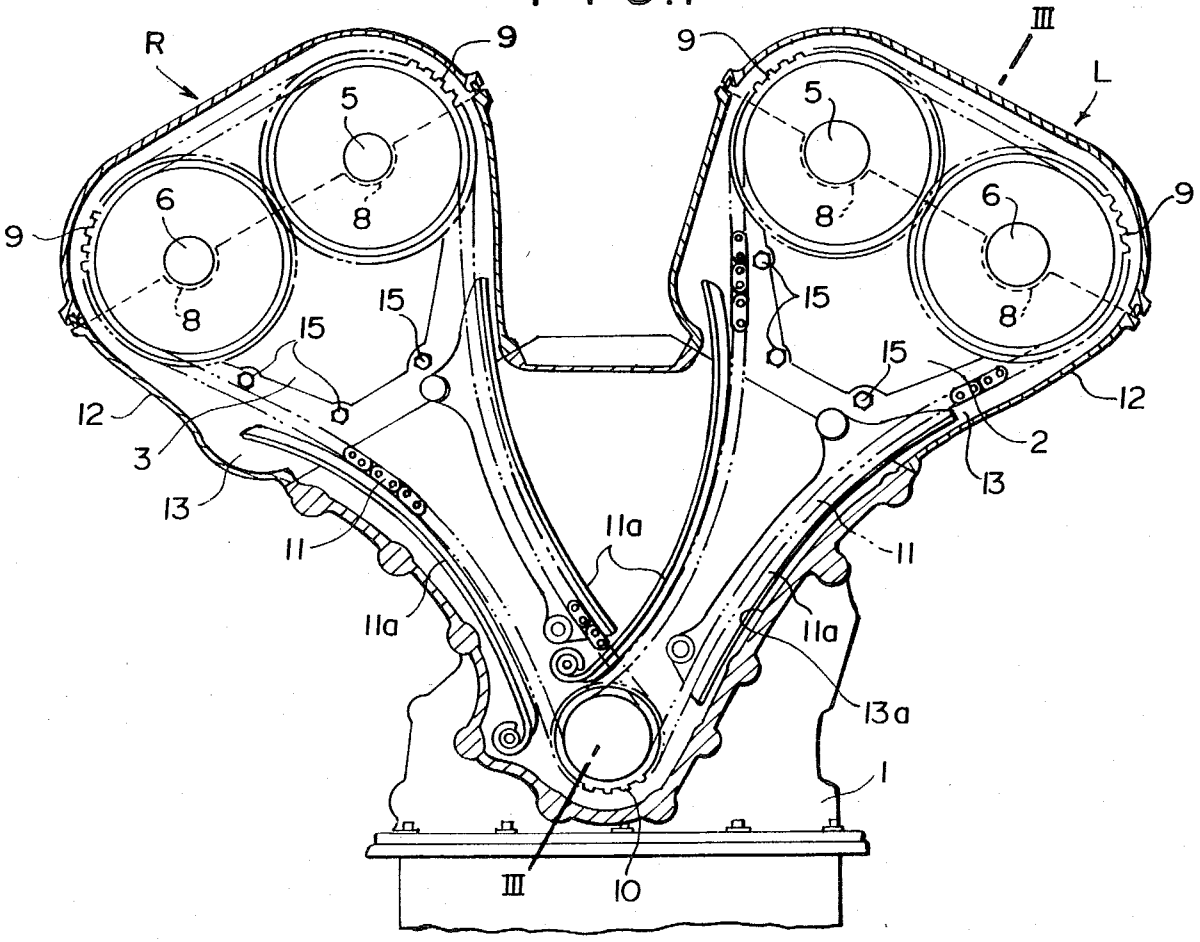
FIG. 1 is a cross-sectional view showing a part of a V-type engine provided with a cylinder head structure in accordance with an embodiment of the present invention.
Figure 2:
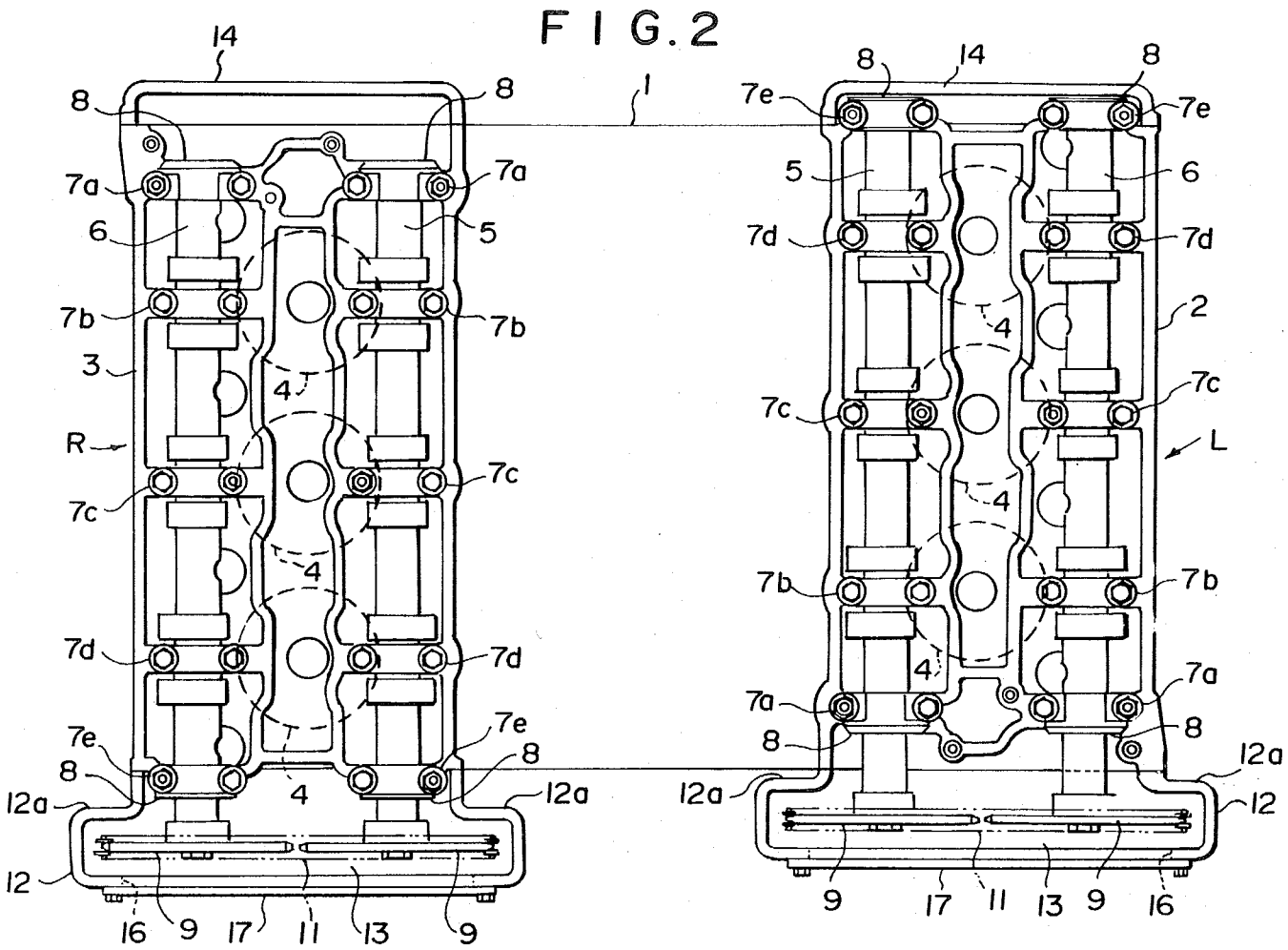
FIG. 2 is a plan view of the same.

In FIGS. 1 and 2 which show a V-type engine provided with a cylinder head structure in accordance with an embodiment of the present invention, reference numeral 1 denotes a cylinder block and reference numerals 2 and 3 respectively denote cylinder heads for left and right cylinder banks L and R provided on the cylinder block 1. Three cylinders 4 each are formed between the cylinder block 1 and the left cylinder head L and between the cylinder block 1 and the right cylinder head R. The cylinder row in the right cylinder bank R is forwardly displaced from the cylinder row in the left cylinder bank L as clearly shown in FIG. 2. The cylinder heads 2 and 3 for the left and right cylinders L and R are the same in shape but are reversed in back-front orientation.

An intake camshaft 5 for exclusively driving the intake valves for the cylinders 4 and an exhaust camshaft 6 for exclusively driving the exhaust valves for the cylinders 4 are provided above each of the cylinder heads 2 and 3 to extend in parallel to the cylinder row. In the upper face of each of the cylinder heads 2 and 3 are formed bearing portions *7a* to *7e* for supporting the camshafts 5 and 6, and in the front and rear end wall portions of each of the cylinder heads 2 and 3 are formed semi-circular openings 8 adapted to receive the camshafts 5 and 6. Each of the camshafts 5 and 6 is supported on the bearing portions *7a* to *7e* so that the front end portion thereof projects forward through the opening 8. As can be understood from comparison of the left and right cylinder banks in FIG. 2, the bearing portion *7a* on one end of each cylinder head is retracted away from the corresponding end face and the bearing portion *7e* on the other end projects beyond the corresponding end face, and the former bearing portion *7a* is forwardly directed in the left cylinder bank L in which the cylinder row is rearwardly disposed with respect to that in the right cylinder bank R as described above while the latter bearing portion *7e* is rearwardly directed in the right cylinder bank R. This contributes to reduction of the distance between the bearing portion and the cam pulley, thereby increasing the supporting rigidity of the camshaft.

Cam pulleys 9 are mounted on the front end portions *5a* and *6a* of the camshafts 5 and 6 projecting forward through the openings 8 in the front end wall portions of the cylinder heads. The cam pulleys 9 in each cylinder bank are drivingly connected to the crank pulley 10 by way of a chain belt 11 which is passes around the cam pulleys 9, the crank pulley 10 and a pair of chain guides *11a*.

Figure 3:
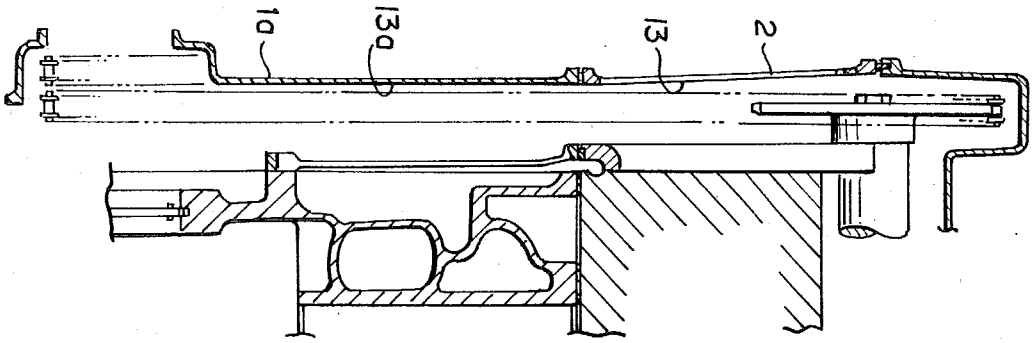
FIG. 3 is a cross-sectional view taken along line III—III in FIG. 1.

On the front side of each of the cylinder heads 2 and 3 is mounted a first cover member 12 to cover the chain belt 11. The first cover member 12 has an opening on the rear side and forms together with the front end portion of the cylinder head a closed cross section space 13 for accommodating therein the chain belt 11. As clearly shown in FIG. 3, the space 13 communicates with a space 13*a* formed on the front end of the cylinder block 1 between the front end and a cover member 1*a* mounted thereon, thereby forming a chain chamber for accommodating therein the chain belt 11. Bolt holes for bolts 15 for fixing the first cover member 12 to the corresponding cylinder head are formed along the edge of the opening. Seal surfaces 12*a* on the left and right sides of the first cover member 12 are bent inwardly behind the chain belt 11 to conform to the width of the cylinder head, and the bolt holes for the bolts 15 are disposed on the inner side of the seal surfaces 12*a*.

A service hole 16 for providing access to the bolts 15 is formed on the front face of the first cover member 12 and a service hole cover 17 is removably mounted on the front face of the first cover member 12.

A second cover member 14 is mounted on the rear side of each of the cylinder heads 2 and 3 to cover the rear side openings 8 in order to prevent oil flowing rearward through the spaces between the camshafts 5 and 6 from leaking out.

In the embodiment described above, the openings 8 through which the camshafts 5 and 6 project are formed in both the front and rear wall portions of the cylinder heads 2 and 3, the camshafts 5 and 6 are supported so that the front end portions thereof project forward through the forwardly positioned openings 8 and the cam pulleys 9 are mounted on the front end portions of the camshafts 5 and 6 in both the cylinder heads. Accordingly, the crank pulley 10 and the chain belts 11 can be positioned on the front side of the engine, and at the same time, the cylinder heads 2 and 3 may be the same in shape.

Further, since the first cover member 12 is separated from the cylinder heads 2 and 3, the width of the cylinder heads 2 and 3 may be smaller than the width of the first cover member 12 by forming the seal surfaces 12*a* to extend inwardly toward the edge of the opening in the rear face of the first cover member 12.

Further, by virtue of the second cover member 14 mounted on the rear ends of the cylinder heads 2 and 3, leakage of oil through the rearwardly positioned openings 8 can be prevented.

The bolts 15 for fixing the first cover member 12 to the cylinder head are positioned inside the seal surfaces 12*a* in the embodiment described above. This is advantageous in that the bolt holes in the cylinder head can be positioned close to each other, and accordingly, the width of the cylinder head can be reduced.

Further, maintenance of the chain belt 11, tension adjustment of the chain belt 11 and the like can be easily effected by removing the service hole cover 17.

We claim:

1. A cylinder head structure for a V-type engine having a pair of cylinder banks comprising a pair of cylinder head members which are the same in shape and oriented in opposite directions and which are provided in each of the front and rear end wall portions with an opening, camshafts supported for rotation in the respective cylinder head members so that the respective one ends of the camshafts project outside through the openings on the same end of the engine, a cam pulley mounted on the projecting portion of each cam shaft, a transmission belt means for transmitting the driving force of the crankshaft to the cam pulley on each camshaft, a pair of first cover members mounted on the end wall portions of the respective cylinder head members through which the camshafts project to form closed cross section spaces together with the corresponding cylinder head members for covering the transmission belt means, and second cover members mounted on the end wall portions of the respective cylinder heads opposite to the end wall portions through which the camshafts project to cover the openings therein.

2. A cylinder head structure as defined in claim 1 in which intake and exhaust camshafts are supported for rotation in each cylinder bank in parallel to each other, the intake camshaft being positioned on the inner side of the exhaust camshaft.

3. A cylinder head structure as defined in claim 1 which is for a four-cycle engine and in which a pair of camshafts are supported for rotation in each cylinder bank, and the cam pulleys on the camshafts in each cylinder bank are driven by the crankshaft by way of a crank pulley having a diameter equal to half of the diameter of the cam pulleys, each of said first cover members being wider than the corresponding cylinder head member and covering the two cam pulleys of the corresponding cylinder bank, and the width of each first cover member being reduced to form a connecting surface to be connected to the cylinder head member.

4. A cylinder head structure as defined in claim 3 in which each of said first cover member is provided with a service hole in the face remote from the cylinder head member, the service hole being substantially equal to the cylinder head member in width and being normally closed by a cover, and mounting bolts for fixing the first cover member to the cylinder head member are disposed in the area corresponding to the service hole.

5. A cylinder head structure as defined in claim 1 in which the cylinder row in one of the cylinder banks is displaced forward of the engine from the cylinder row in the other cylinder bank, the journal for supporting the corresponding end of the camshaft projects axially outside beyond the surface on which the corresponding cover member abuts against the cylinder head member on one end of each of the cylinder head members and the journal for supporting the corresponding end of the camshaft is retracted inwardly from the surface on which the corresponding cover member abuts against the cylinder head cover member on the other end of the cylinder head member, the cam pulleys for the respective cylinder banks being disposed on the front side of the engine and driven by way of separate transmission belts, the transmission belt for driving the cam pulley for the cylinder bank in which the cylinder row is forwardly displaced from the cylinder row in the other cylinder bank is passed around the crank pulley on the side remote from the engine and the transmission belt for driving the cam pulley for the other cylinder bank is passed around the crank pulley on the side near the engine, said cylinder head members being positioned so that the end on which the the journal for supporting the corresponding end of the camshaft projects axially outside beyond the surface on which the corresponding cover member abuts against the cylinder head member is directed forward in the cylinder bank in which the cylinder row is forwardly displaced and is directed rearward in the other cylinder bank.

6. A cylinder head structure for a V-type engine in which the cylinder row in one cylinder bank is longitudinally displaced from the cylinder row in the other cylinder bank comprising a pair of cylinder head members which are the same in shape and are mounted on a cylinder block as reversed in front-back orientation and which are provided in each of the front and rear end wall portions with semicircular openings each of which forms a circular opening for receiving a camshaft together with a semicircular opening formed in a cylinder head cover to be mounted on the cylinder head member, a pair of camshafts supported for rotation on each of the cylinder head members to project forward through the circular openings formed on the front side of the cylinder head member, a pair of cam pulleys which are respectively mounted on the front end of the camshafts in each of the cylinder head members and are drivingly connected to a crank pulley having a diameter equal to half of the diameter thereof by way of a chain, and chain chambers formed in the front sides of the cylinder block and the cylinder head members to cover the chains and the pulleys, the chain chamber of the front end of the cylinder head members being formed by the end faces of the respective cylinder head members and a pair of first cover members which are mounted on the front ends of the respective cylinder head members to cover the pair of cam pulleys, the rear side of each first cover member being reduced in width and connected to the corresponding cylinder head member, each first cover member being provided with an upper opening closed by the cylinder head cover and a lower opening communicated with the chain chamber on the front end of the cylinder block, the rear end of each of the cylinder head members being closed by a second cover member having a width substantially equal to the width of the cylinder head member.

7. A cylinder head structure as defined in claim 6 in which said chain chamber on the front end of the cylinder block is formed by the front end of the cylinder block and a third cover member mounted on the front end.

8. A cylinder head structure as defined in claim 7 in which the cylinder row in one of the cylinder banks is displaced forward of the engine from the cylinder row in the other cylinder bank, the journal for supporting the corresponding end of the camshaft projects axially outside beyond the surface on which the corresponding cover member abuts against the cylinder head member on one end of each of the cylinder head members and the journal for supporting the corresponding end of the camshaft is retracted inwardly from the surface on which the corresponding cover member abuts against the cylinder head cover member on the other end of the cylinder head member, the cam pulleys for the respective cylinder banks being disposed on the front side of the engine and driven by way of separate transmission belts, the transmission belt for driving the cam pulley for the cylinder bank in which the cylinder row is forwardly displaced from the cylinder row in the other cylinder bank is passed around the crank pulley on the side remote from the engine and the transmission belt for driving the cam pulley for the other cylinder bank is passed around the crank pulley on the side near the engine, said cylinder head members being positioned so that the end on which the the journal for supporting the corresponding end of the camshaft projects axially outside beyond the surface on which the corresponding cover member abuts against the cylinder head member is directed forward in the cylinder bank in which the cylinder row is forwardly displaced and is directed rearward in the other cylinder bank.

9. A cylinder head structure as defined in claim 6 in which each of said first cover member is provided with a service hole in the face remote from the cylinder head member, the service hole being substantially equal to the cylinder head member in width and being normally closed by a cover, and mounting bolts for fixing the first cover member to the cylinder head member are disposed in the area corresponding to the service hole.

10. A V-type engine comprising a cylinder block, a pair of cylinder heads fixedly mounted on the cylinder block to form left and right cylinder banks, the cylinder row in one cylinder bank being longitudinally displaced from the cylinder row in the other cylinder bank, and a pair of camshafts supported for rotation in the cylinder heads, the camshafts being arranged to be driven by separate transmission belts which are respectively connected to the camshafts at one ends of the camshafts and are offset from each other in the direction of the crankshaft, characterized in that the camshaft for the cylinder head the cylinder row in which is displaced toward the transmission belts is driven by the transmission belt remote from the engine, the journal for supporting said one end of the camshaft projecting axially outside beyond the end of the cylinder head and the camshaft for the other cylinder head is driven by the transmission belt adjacent to the engine and the journal for supporting said one end of the camshaft is retracted inwardly from the end of the cylinder head, a cover member being mounted on the end of each cylinder head to form a part of a chamber for accommodating the transmission belt together with the end face of the cylinder head.

* * * * *